United States Patent [19]

Chalberg

[11] 4,349,923

[45] Sep. 21, 1982

[54] JET NOZZLE ASSEMBLY FOR THERAPY BATHS

[76] Inventor: Philip E. Chalberg, 1119 Maple Ave., Orange, Calif. 92668

[21] Appl. No.: 215,888

[22] Filed: Dec. 12, 1980

[51] Int. Cl.[3] ..... A61H 33/02

[52] U.S. Cl. ..... 4/542; 4/541; 4/492

[58] Field of Search ..... 4/492, 507, 542, 559; 128/66

[56] References Cited

U.S. PATENT DOCUMENTS

| | | | |
|---|---|---|---|
| 3,628,529 | 12/1971 | Steimle | 4/559 X |
| 3,665,525 | 5/1972 | Howard | 4/492 |
| 3,890,655 | 6/1975 | Mathis | 4/542 |
| 4,262,371 | 4/1981 | Barry et al. | 4/492 X |
| 4,264,039 | 4/1981 | Moreland | 4/542 X |

*Primary Examiner*—Henry K. Artis

*Attorney, Agent, or Firm*—Fischer, Tachner & Strauss

[57] ABSTRACT

An adjustable nozzle assembly primarily for controlling the direction of a water-air jet of the type commonly found in whirlpool or therapy baths. The assembly comprises four components, namely, a pair of threaded flanged fittings, an eyeball shaped nozzle having a cylindrical channel therethrough, and a retaining ring for securing the eyeball nozzle in one of the threaded fittings. The two fittings are of cylindrical construction adapted to be concentric to each other. An outer fitting has threads along both the internal and external cylindrical wall thereof. The external thread is adapted to mate the outer fitting with a suitable source outlet pipe. The inner thread of one outer fitting is designed to mate with the corresponding outer thread on the inner fitting which tightens down concentrically therewith. The two fittings have overlapping annular flanges, the flange of the inner fitting being slightly larger than the flange of the outer fitting to provide a smooth continuous finished appearance when the assembly is fully installed through a suitable aperture in the wall of a tub. The aperture of the eyeball nozzle through which the water-air jet exits is designed to terminate substantially in the plane of the inner fitting flange to avoid protrusions which would otherwise create a likelihood of injury to the user. The four components of the present invention are of unique but simple structure which may be manufactured from molded plastic and assembled together without the use of hardware.

10 Claims, 4 Drawing Figures

JET NOZZLE ASSEMBLY FOR THERAPY BATHS

BACKGROUND OF THE INVENTION

1. Field of the Invention

The present invention pertains generally to fixtures for therapy baths and more specifically, to an adjustable jet nozzle assembly for directing a high flow rate mixture of water and air from a source outlet to the interior of a therapy tub.

2. Prior Art

The general concept of utilizing a nozzle adjustable in angle for the purpose of directing a high flow rate combination of water and air in a hydrobath or therapy bath is well known in the art. However, such prior art adjustable nozzle assemblies have one or more disadvantages relative to the present invention. More specifically, prior art devices that are used for adjusting the direction of hydrobath jets are relatively disadvantageous from a standpoint of either safety, appearance, cost, or a combination of these factors. By way of example, from the safety standpoint it will be seen hereinafter that the present invention is designed to provide a nozzle assembly which extends only slightly beyond the interior wall surface of the tub and which provides a relatively flat minimum protrusion which is devoid of sharp surfaces, corners and the like which might otherwise be injurious to the user. Furthermore it will be seen hereinafter that the present invention provides a nozzle assembly which obviates prior art requirements for retaining hardware such as screws and the like which would otherwise increase the cost of the assembly and degrade the appearance of the assembly. The present invention also provides a nozzle assembly having an externally visible structure which is of smooth and continuous design with a finished look that substantially enhances the overall appearance of the assembly relative to the prior art. Furthermore, it will be seen hereinafter that the present invention provides a nozzle assembly which utilizes a minimum number of parts, each of which is designed for structural simplicity and permits the use of molded plastic components without requiring any interface hardware. The result is a nozzle assembly that is both inexpensive to manufacture and inexpensive to maintain and repair.

By way of example, in the following table are listed a plurality of pertinent U.S. patents which disclose a substantial portion of the known prior art relative to adjustable nozzle assemblies for therapy pools and the like.

| U.S. Pat. No. | Inventor |
|---|---|
| 3,540,438 | Jacuzzi |
| 3,605,131 | Brazel et al |
| 3,628,529 | Steimle |
| 3,662,406 | Giglio |
| 3,788,306 | Eberhard |
| 3,859,990 | Simon |
| 3,890,656 | Mathis |
| 3,905,358 | Jacuzzi |
| 3,985,303 | Steimle |
| 3,986,217 | Doerr et al |

More specifically, U.S. Pat. No. 3,540,438 (Jacuzzi) discloses a nozzle assembly having a ball end for use as a hydro-air jet head. Bordering the open end of the bathtub side of the housing is an outwardly directed flange having spaced screw holes for mounting the assembly to the tub wall. The screw heads are hidden by means of a liner which also includes outwardly directed flanges conforming to and enclosing the mounting flange of the housing. Thus the structure is complex and costly and requires hardware.

U.S. Pat. No. 3,890,656 (Mathis) discloses a jet outlet control with an angularly directed water channel. Rotation of the control by means of a coin slot changes the orientation of the channel thereby changing the direction of the flow of water into the tub. Thus a special piece of hardware is needed to effect a directional change in the nozzle.

U.S. Pat. No. 3,605,131 (Brazel et al.) discloses a nozzle that has a ball shaped head which is rotatably mounted in a matching cup ring. The cup ring is fitted in a corresponding bore and nozzle housing and is pressed against the ball head of the nozzle by a compression spring that abutts against a shoulder of the nozzle housing. The nozzle is tensioned toward the front and bears against a curved ball which is held in place by a screw. Thus complexity and hardware are the disadvantages here.

U.S. Pat. No. 3,628,529 (Steimle) discloses an adjustable nozzle comprising a tubular socket fitting having a threaded connection with the interior of an outlet passage. An outlet nozzle is held adjustably socketed in a seat by means of a bushing having its threaded interior mated with corresponding threads. The primary disadvantage of this device is the extent to which it protrudes beyond the tub wall surface.

U.S. Pat. No. 3,662,406 (Giglio) discloses a forward removable spout that has an eccentric passage the angle of which may be changed relative to the horizontal by rotating the spout. It also suffers the disadvantage of a safety hazard because of the extent to which it protrudes beyond the tub wall surface.

U.S. Pat. No. 3,788,306 (Eberhard) discloses a nozzle which includes a longitudinal stem or spout with a head having a linear bore. The head is spherical and is universally mounted in a seat for movement but may be locked in a selected position by a retaining cap which has a tapered flange to conform to the spherical shape of the head. This device is relatively complex and also protrudes beyond the tub wall surface with a comparatively sharp and thus hazardous member.

U.S. Pat. No. 3,859,990 (Simon) discloses a rotary spout with apparent substantial structure extending beyond the surface of the wall creating a potentially serious safety hazard.

U.S. Pat. No. 3,905,358 (Jacuzzi) discloses a cylindrical nozzle which is received at its rearward end in the interior of a ball-shaped device by means of helical threads on the exterior surface of the nozzle and the interior surface of the ball. It is a relatively complex device that would require hardware for both tub applications.

U.S. Pat. No. 3,985,303 (Steimle) discloses a socket which receives an eyeball fitting having a conical bore. The eyeball is held adjustably seated in the socket by a nut ring which is engaged with a thread on the outer exterior of the coupling. The outer end half of the ring is formed with a spherical seat and includes a low height sealing ring. This device presents a hazard because of the extent to which it protrudes beyond the tub wall surface.

U.S. Pat. No. 3,986,217 (Doerr et al.) discloses a nozzle assembly which comprises a disk flange having a swivel member with an outer surface forming a portion of a sphere and slideably mounted on a spherical seat. An outlet and back plate are arranged to keep the nozzle arrangement mounted on the end wall of a tub. A retainer is screwed on the outside of the spherical seat to urge the swivel member towards the tub wall. This device is unsafe, relatively complex, and relatively unattractive.

Thus it will be seen that all the aforementioned prior art suffers from one or more of the above-indicated disadvantages relative to the present invention.

SUMMARY OF THE INVENTION

The adjustable nozzle assembly of the present invention comprises four components, namely, a pair of threaded, flanged fittings, a spherical or "eyeball" shaped nozzle having a cylindrical channel therethrough, and a retaining ring. The two fittings are of cylindrical construction adapted to be concentric with each other. The outer fitting has threads along both the internal and external cylindrical wall. The external thread is adapted to mate the outer fitting with a suitable source outlet which provides a high velocity flow rate of water and air to form the whirlpool jet. The inner thread of the outer fitting is designed to mate with a corresponding outer thread on the inner fitting which tightens down concentrically therewith. The inner and outer fittings have overlapping annular flanges at the respective ends thereof located on the side of the fittings visible to the user. The annular flange of the outer fitting is flat on the tub wall side for engaging the flat surface of the tub wall and curved on the opposite side. The flange of the inner fitting is curved on the tub wall side and substantially congruent to the curved surface of the outer fitting to provide a conformal meeting of the two flanges when the inner fitting is threadably inserted into the outer fitting.

The eyeball nozzle is contained within the inner fitting by a retaining ring which is press fit along the inner diameter of the inner fitting at the end thereof that protrudes through the tub wall toward the tub exterior. The exit aperture of the eyeball nozzle is designed to terminate in the plane of the inner fitting flange to avoid protrusions which would otherwise create a likelihood of injury to the user. The eyeball nozzle is seated within the inner fitting by a first curved surface along the retaining ring and a second curved surface along the inside annular portion of the flange of the inner fitting. These two curved surfaces and the inside surface of the inner fitting form a socket in which the eyeball nozzle may be rotated to control the direction of flow of the jet.

OBJECTS

It is therefore a principal object of the present invention to provide an adjustable jet nozzle assembly for a whirlpool bath and having improved safety and appearance, and reduced manufacturing cost.

It is an additional object of the present invention to provide an adjustable jet nozzle assembly for a whirlpool bath and the like which is adapted to be secured to a suitable source outlet pipe through an aperture in the wall of a tub and which provides means for controlling the direction of the nozzle thereof with a minimum of members extending beyond the tub wall surface and no accessible protruberances or sharp edges which would otherwise increase the likelihood of injury.

It is still an additional object of the present invention to provide an adjustable jet nozzle assembly for whirlpool baths and the like and which is adapted for installation without requiring any fastening devices or other hardware and which provides an attractive finished appearance of simple smooth lines for maximum esthetic appeal.

It is still an additional object of the present invention to provide an adjustable jet nozzle assembly for whirlpool baths which is inexpensive to manufacture, requires no hardware to assemble and utilizes a minimum number of structurally simple and inexpensive parts that may be manufactured from molded plastic.

BRIEF DESCRIPTION OF THE DRAWINGS

The aforementioned objects and advantages of the present invention, as well as additional objects and advantages thereof, will be more fully understood hereinafter as a result of the detailed description of the invention taken in conjunction with the appended drawings in which.

DETAILED DESCRIPTION OF A PREFERRED EMBODIMENT

Figure 1:
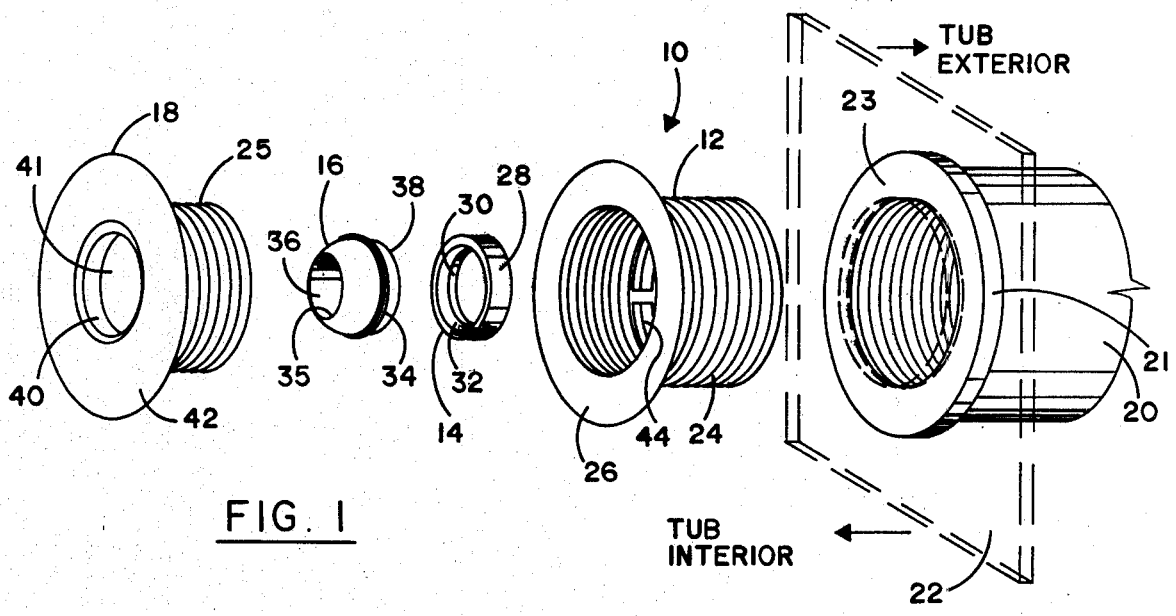
FIG. 1 is an exploded view of the present invention and a tub wall and source outlet to which the present invention would be connected.

Referring now to FIG. 1 there is shown an adjustable jet nozzle assembly 10 of the present invention comprising an outer cylindrical fitting 12, a retaining ring 14, an eyeball nozzle 16, and an inner cylindrical fitting 18 which is adapted to be concentric with fitting 12. Assembly 10 is designed to extend through an aperture 23 in a tub wall 22 to mate with a source outlet 20. Outlet 20 provides a high flow rate jet of water and air to assembly 10 in a well known manner.

Outer fitting 12 is threaded along both the inner and outer surfaces of its cylindrical portion 24. The threading along the outer surface of portion 24 is designed to mate with compatible threading along the inner surface of source outlet 20. When outer fitting 12 is fully threaded into the source outlet, it is held securely within the source outlet 20. The tub wall 22 is then firmly secured between outlet flange 21 of source outlet 20 and flange 26 of outer fitting 12.

The interior threaded surface of fitting 12 is designed to receive the inner fitting 18 which has a matching threaded surface along the exterior of its cylindrical portion 25. Flange 26 of fitting 12 which has a flat surface on the tub wall side for mating with tub wall 22 and a convex surface on the opposite side thereof. Flange 42 of fitting 18 has a concave surface adapted to overlie flange 26 of fitting 12 and a suitable matching plano-convex surface on the opposite side thereof which is adapted to provide an esthetically appealing smooth continuous surface visible from the tub interior when the present invention is fully assembled and installed through the tub wall orifice.

However, before the inner fitting 18 is threadably inserted into outer fitting 12, eyeball nozzle 16 is secured within a suitable seat interior to the inner fitting 18 by means of retaining ring 14. As shown in FIG. 1, retaining ring 14 is a cylindrical ring having an outer surface 28 and an inner surface 30. The inner surface is beveled or otherwise shaped to provide a generally curved surface 32 which is designed to receive the corresponding curved surface of eyeball nozzle 16 and provide a ball-type seat therefore. A similar curved surface 40 is provided at the periphery of exit aperture 41 along the inner annular surface of flange 42 of fitting 18. Surface 40 provides compatible seating for the portion of the eyeball nozzle 16 adjacent its exit orifice 36. Eyeball nozzle 16 is substantially spherical in shape but truncated at the intersection of its cylindrical passageway 35 and the ball surface. Those intersections form entrance aperture 38 and exit aperture 36. Entrance aperture 38 is slightly larger than exit aperture 36 because of a short beveled surface adjacent the entrance aperture which provides a smooth flow channel for the exiting water and air. A stopper ridge 34 around the approximate mid-point of eyeball nozzle 16, provides a means for limiting the angular travel of the nozzle 16 during use.

Figure 2:
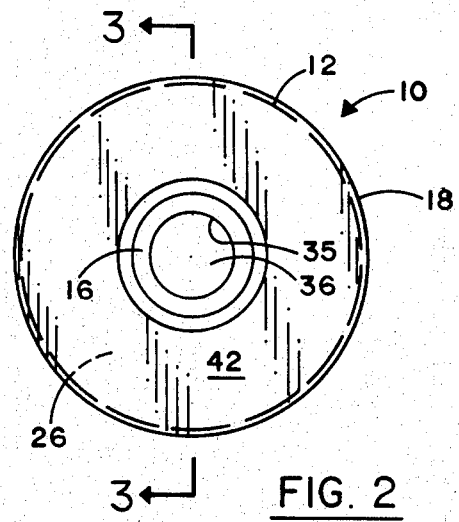
FIG. 2 is a front view of the present invention in a fully assembled configuration.
Figure 3:
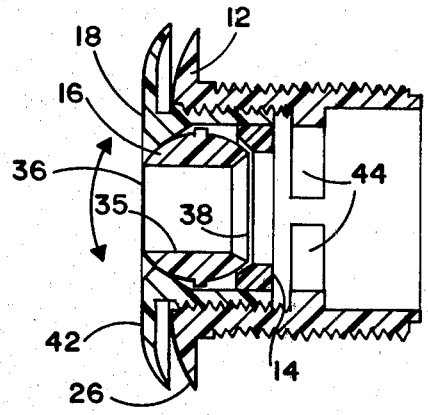
FIG. 3 is a sectional view of the invention taken along lines 3—3 of FIG. 2.
Figure 4:
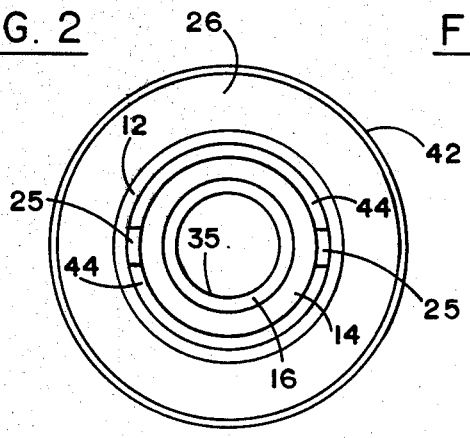
FIG. 4 is a rear view of the invention.

In FIGS. 2–4 the four components of the invention are shown in fully assembled configuration, in front, side-sectional and rear views respectively. Thus, the view of the invention provided in FIG. 2 is that which the user would see when looking at a tub wall surface in which the invention is installed. It will be apparent that the only portions visible to the user are flange 42 of inner fitting 18, and a portion of eyeball nozzle 16 oriented at a selected rotational position to provide a jet emanating from external orifice 36. Flange 26 of outer fitting 12 which is slightly smaller in diameter than the flange 42 of fitting 18, is shown in dotted line in FIG. 2 because when the assembly 10 of the present invention is fully installed no portion of outer fitting 12 is visible.

The detailed structure and interconnection of the four components of the present invention may be best understood from the sectional view provided in FIG. 3 in which it will be seen that the inner fitting 18 is fully inserted into the outer fitting 12 with eyeball socket 16 in place and seated firmly by means of retaining ring 14. It will also be seen in FIG. 3 that the inner surface of outer fitting 12 is only partially threaded, the remaining portion thereof towards the end opposite the flange having a smooth surface. On that smooth surface, just beyond the threaded portion of the interior surface of fitting 12, there are located a pair of spanner ridges 44. Spanner ridges 44 provide a means for tightening down fitting 12 after it has been threadably inserted in source outlet 20 but prior to the insertion of fitting 18 along with the eyeball nozzle and retaining ring. These ridges are also shown in the rear view of FIG. 4 in which it can be seen that the ridges provide a means for forcibly rotating outer fitting 12 so that it can be firmly secured into the source outlet 20. Ridges 44 also provide means for forcibly rotating outer fitting 12 in the opposite rotational direction, for removal of the fitting from the source outlet for maintenance or replacement purposes.

It will now be understood that what has been disclosed herein is an improved adjustable jet nozzle assembly primarily for use in whirlpool baths. The assembly provides advantages relating to safety, appearance, and cost in comparison to prior art whirlpool bath nozzle assemblies. The invention is designed to extend through an aperture in the wall surface of a whirlpool bathtub into a threaded source outlet pipe. It comprises four components, namely, a pair of concentric flanged threaded fittings, an eyeball nozzle, and a retaining ring. As a result of its unique but simple construction the nozzle assembly of the present invention reduces the likelihood of injury to the whirlpool bath user which injury might otherwise result from inadvertent forceful contact with a portion of a prior art nozzle that protrudes through the tub wall surface. In addition, the present invention provides means for assembling and securing the invention to the tub wall source outlet without requiring any hardware and by providing an attractive finished appearance that enhances the esthetic appeal of the whirlpool bath. Furthermore, because the invention requires no hardware for assembly and because it uses only four components of relative structural simplicity which may be molded of plastic, the invention is inexpensive to produce in comparison to prior art assemblies for whirlpool baths.

It will now also be understood that various modifications may be made to the present invention as compared to the specific preferred embodiment described herein. By way of example, variations may be made to the geometry of the various components and to the manner in which they are physically interconnected without departing from the true spirit and scope of the invention which is to be limited only by the appended claims.

I claim:

1. A nozzle assembly for connection to a source outlet through an orifice in the wall of a whirlpool bath for controlling the direction of flow of a high velocity stream of aerated water into the bathtub, the assembly comprising:

a first cylindrical pipe fitting having an annular flange at one end for compressive engagement with said wall, and having means for securely engaging said source outlet, a second cylindrical pipe fitting having an annular flange at one end for compressive overlapping engagement with said first fitting flange, and having means for securely engaging said first cylindrical pipe fitting in concentric relation therewith said second fitting flange completely blocking said first fitting flange from view, a spherical member having a cylindrical channel for passage of said aerated water, said spherical member being rotatably seated within said second cylindrical pipe fitting, with said channel providing said flow direction control, and means for rotatably securing said spherical member within said second cylindrical pipe fitting for limited rotation therein.

2. The nozzle assembly defined in claim 1 wherein said means for securely engaging said first cylindrical pipe fitting with said source outlet comprises a threaded outer surface.

3. The nozzle assembly defined in claim 1 wherein said first cylindrical pipe fitting has a threaded inner surface and wherein said means for securely engaging said second cylindrical pipe fitting with said first cylindrical pipe fitting comprises a threaded outer surface compatible with said threaded inner surface.

4. The nozzle assembly defined in claim 1 wherein said annular flange of said first fitting is substantially planar on its one side for engagement with said tub wall and substantially convex on its opposite side for engagement with said second fitting flange.

5. The nozzle assembly defined in claim 4 wherein said annular flange of said second fitting is substantially concave on its one side for engagement with said first fitting flange and substantially convex on its opposite side.

6. A nozzle assembly for connection to a source outlet through an orifice in the wall of a whirlpool bath for controlling the direction of flow of a high velocity stream of aerated water into the bathtub, the assembly comprising:

a first cylindrical pipe fitting having an annular flange at one end for compressive engagement with said wall, having a threaded outer surface for securely engaging said source outlet, and having a threaded inner surface, a second cylindrical pipe fitting having an annular flange at one end for compressive overlapping engagement with said first fitting flange and having a threaded outer surface compatible with said threaded inner surface of said first cylindrical pipe fitting for securely engaging said first cylindrical pipe fitting in concentric relation therewith said second fitting flange completely blocking said first fitting flange from view, a spherical member having a cylindrical channel for passage of said aerated water, said spherical member being rotatably seated within said second cylindrical pipe fitting with said channel providing said flow direction control, and means for rotatably securing said spherical member within said second cylindrical pipe fitting for limited rotation therein.

7. The nozzle assembly defined in claim 1 wherein said means for rotatably securing said spherical member comprises a retaining ring having an outer diameter substantially equal to the inner diameter of said second cylindrical pipe fitting and having an inner annular surface substantially coincident with said spherical member.

8. The nozzle assembly defined in claim 2 wherein said first cylindrical pipe fitting further comprises a plurality of spaced-apart annular ridges along the inner surface of said first fitting for forcively rotating said first fitting into secure engagement with said source outlet.

9. The nozzle assembly defined in claim 6 wherein said annular flange of said first fitting is substantially planar on its one side for engagement with said tub wall and substantially convex on its opposite side for engagement with said second fitting flange, and wherein said annular flange of said second fitting is substantially concave on its one side for engagement with said first fitting flange and substantially convex on its opposite side.

10. The nozzle assembly defined in claim 9 wherein said means for rotatably securing said spherical member comprises a retaining ring having an outer diameter substantially equal to the inner diameter of said second cylindrical pipe fitting and having an inner annular surface substantially coincident with said spherical member, and wherein said first cylindrical pipe fitting further comprises a plurality of spaced-apart annular ridges along the inner surface of said first fitting for forcibly rotating said first fitting into secure engagement with said source outlet.

* * * * *

REEXAMINATION CERTIFICATE (1047th)

United States Patent [19]

Chalberg

[11] B1 4,349,923

[45] Certificate Issued Apr. 25, 1989

[54] JET NOZZLE ASSEMBLY FOR THERAPY BATHS

[76] Inventor: Philip E. Chalberg, 1119 Maple Ave., Orange, Calif. 92668

Reexamination Request:
No. 90/001,499, Apr. 26, 1988

Reexamination Certificate for:

| | |
|---|---|
| Patent No.: | **4,349,923** |
| Issued: | **Sep. 21, 1982** |
| Appl. No.: | **215,888** |
| Filed: | **Dec. 12, 1980** |

[51] Int. Cl.[4] ..... A61H 33/02

[52] U.S. Cl. ..... 4/542; 4/492; 4/541; 239/428.5

[58] Field of Search ..... 4/492, 541, 542, 543, 4/544, 490; 239/587, 600; 128/66; 285/46, 158, 160, 161, 200, 206

[56] References Cited

U.S. PATENT DOCUMENTS

| | | | |
|---|---|---|---|
| 1,734,966 | 11/1929 | Elmendorf | 285/206 X |
| 3,540,438 | 0/1970 | Jacuzzi . | |
| 3,605,131 | 0/1971 | Brazel et al. . | |
| 3,628,529 | 0/1971 | Steimle . | |
| 3,662,406 | 5/1972 | Giglio . | |
| 3,665,525 | 5/1972 | Howard . | |
| 3,749,424 | 7/1973 | Greene | 285/161 |
| 3,788,306 | 1/1974 | Eberhard . | |
| 3,859,990 | 1/1975 | Simon . | |
| 3,890,655 | 6/1975 | Mathis . | |
| 3,890,656 | 6/1975 | Mathis . | |
| 3,905,358 | 9/1975 | Jacuzzi . | |
| 3,946,449 | 5/1976 | Mathis . | |
| 3,985,303 | 10/1976 | Steimle . | |
| 3,986,217 | 10/1976 | Doerr et al. . | |
| 4,262,371 | 4/1981 | Berry et al. | 4/542 X |
| 4,264,039 | 4/1981 | Moreland | 4/542 X |
| 4,387,854 | 6/1983 | Dupont | 4/492 X |
| 4,542,853 | 9/1985 | Diamond | 239/428.5 X |

*Primary Examiner*—Charles E. Phillips

[57] ABSTRACT

An adjustable nozzle assembly primarily for controlling the direction of a water-air jet of the type commonly found in whirlpool or therapy baths. The assembly comprises four components, namely, a pair of threaded flanged fittings, an eyeball shaped nozzle having a cylindrical channel therethrough, and a retaining ring for securing the eyeball nozzle in one of the threaded fittings. The two fittings are of cylindrical construction adapted to be concentric to each other. An outer fitting has threads along both the internal and external cylindrical wall thereof. The external thread is adapted to mate the outer fitting with a suitable source outlet pipe. The inner thread of one outer fitting is designed to mate with the corresponding outer thread on the inner fitting which tightens down concentrically therewith. The two fittings have overlapping annular flanges, the flange of the inner fitting being slightly larger than the flange of the outer fitting to provide a smooth continuous finished appearance when the assembly is fully installed through a suitable aperture in the wall of a tub. The aperture of the eyeball nozzle through which the water-air jet exits is designed to terminate substantially in the plane of the inner fitting flange to avoid protrusions which would otherwise create a likelihood of injury to the user. The four components of the present invention are of unique but simple structure which may be manufactured from molded plastic and assembled together without the use of hardware.

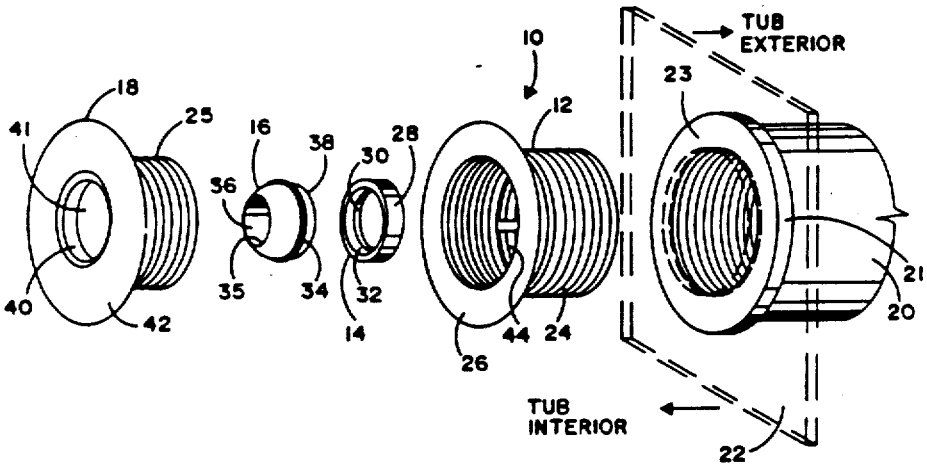

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are determined to be patentable as amended.

Claims 2-5 and 7-10, dependent on an amended claim, are determined to be patentable.

1. A nozzle assembly for connection to a source outlet through an orifice in the wall of a whirlpool bath for controlling the direction of flow of a high velocity stream of aerated water into the bathtub, the assembly comprising:

a first cylindrical pipe fitting having an annular flange at one end for compressive engagement with said wall, and having means for securely engaging said source outlet, a second cylindrical pipe fitting having an annular flange at *a first* [one] end for compressive overlapping engagement with said first fitting flange, and having means for securely engaging said first cylindrical pipe fitting in concentric relation therewith, said second fitting flange completely blocking said first fitting flange from view, a spherical member having a cylindrical channel for passage of said aerated water, said spherical member being rotatably seated within said second cylindrical pipe fitting, with said channel providing said flow direction control, and, means for rotatably securing said spherical member within said second cylindrical pipe fitting *coupled to a second end of said second cylindrical pipe fitting* for limited rotation therein *whereby said spherical member is captured between said rotatable securement means and said first end of said second cylindrical pipe fitting.*

6. A nozzle assembly for connection to a source outlet through an orifice in the wall of a whirlpool bath for controlling the direction of flow of a high velocity stream of aerated water into the bathtub, the assembly comprising:

a first cylindrical pipe fitting having an annular flange at one end for compressive engagement with said wall, having a threaded outer surface for securely engaging said source outlet, and having a threaded inner surface, a second cylindrical pipe fitting having an annular flange at *a first* [one] end for compressive overlapping engagement with said first fitting flange and having a threaded outer surface compatible with said threaded inner surface of said first cylindrical pipe fitting for securely engaging said first cylindrical pipe fitting in concentric relation therewith, said second fitting flange completely blocking said first fitting flange from view, a spherical member having a cylindrical channel for passage of said aerated water, said spherical member being rotatably seated within said second cylindrical pipe fitting with said channel providing said flow direction control, and, means for rotatably securing said spherical member within said second cylindrical pipe fitting *coupled to a second end of said second cylindrical pipe fitting* for limited rotation therein *whereby said spherical member is captured between said rotatable securement means and said first end of said second cylindrical pipe fitting.*

* * * * *